US011185881B2

(12) United States Patent
Ishida et al.

(10) Patent No.: US 11,185,881 B2
(45) Date of Patent: Nov. 30, 2021

(54) DRYING FACILITY FOR PAINTING

(71) Applicants: Taikisha Ltd., Tokyo (JP); Mayekawa Mfg. Co., Ltd., Tokyo (JP)

(72) Inventors: Kozo Ishida, Tokyo (JP); Fujio Komatsu, Tokyo (JP); Hirokazu Yoneda, Tokyo (JP)

(73) Assignees: Taikisha Ltd., Tokyo (JP); Mayekawa Mfg. Co., Ltd., Tokyo (JP)

( * ) Notice: Subject to any disclaimer, the term of this patent is extended or adjusted under 35 U.S.C. 154(b) by 95 days.

(21) Appl. No.: 16/342,332

(22) PCT Filed: Aug. 31, 2017

(86) PCT No.: PCT/JP2017/031402
§ 371 (c)(1),
(2) Date: Apr. 16, 2019

(87) PCT Pub. No.: WO2018/109990
PCT Pub. Date: Jun. 21, 2018

(65) Prior Publication Data

US 2019/0283065 A1 Sep. 19, 2019

(30) Foreign Application Priority Data

Dec. 14, 2016 (JP) ..... JP2016-242201

(51) Int. Cl.
*B05B 16/20* (2018.01)
*B05C 15/00* (2006.01)
(Continued)

(52) U.S. Cl.
CPC ..... *B05B 16/20* (2018.02); *B05C 9/14* (2013.01); *B05C 15/00* (2013.01); *F24F 3/147* (2013.01);
(Continued)

(58) Field of Classification Search
None
See application file for complete search history.

(56) References Cited

U.S. PATENT DOCUMENTS 6,442,951 B1 9/2002 Maeda et al.
2002/0040575 A1 4/2002 Okano et al.
(Continued)

FOREIGN PATENT DOCUMENTS

JP 5987537 U 6/1984
JP S5987537 U 6/1984
(Continued)

*Primary Examiner* — Jethro M. Pence
(74) *Attorney, Agent, or Firm* — The Webb Law Firm

(57) ABSTRACT

A dehumidification forward passage is provided for guiding air withdrawn from a treating chamber as dehumidification-subject air A" to an adsorption area of an adsorption/desorption type dehumidifying device. A dehumidification return passage is provided for guiding air A" past through the adsorption area to the treating chamber. A desorption heat pump is provided for heating desorbing air HA to be flown through a desorption area of adsorption/desorption type dehumidifying device, with utilizing, as a heat sink, dehumidified air A" which has flown through the adsorption area and sent to the dehumidification return passage. There is provided a sensible-heat heat exchanger configured to cool the dehumidification-subject air A" present in the dehumidification forward passage through a heat exchange reaction with dehumidified air A" present in the dehumidification return passage which has been cooled via absorption of its heat by the desorption heat pump.

7 Claims, 1 Drawing Sheet

| | temperature (°C) | absolute humidity (g/kg') |
|---|---|---|
| a | 50 | 10 |
| b | 50 | 10 |
| c | 38 | 25.4 |
| d | 46.8 | 11.5 |
| e | 25.9 | 11.5 |
| f | 14.5 | 9.8 |
| g | 12.8 | 5.5 |
| h | 35.7 | 5.5 |

(51) Int. Cl.

| | |
|---|---|
| ***B05C 9/14*** | (2006.01) |
| ***F26B 21/00*** | (2006.01) |
| ***F26B 15/12*** | (2006.01) |
| ***F24F 3/147*** | (2006.01) |
| ***F26B 3/04*** | (2006.01) |

(52) U.S. Cl.
CPC ..... *F26B 3/04* (2013.01); *F26B 15/12* (2013.01); *F26B 21/00* (2013.01)

(56) References Cited

U.S. PATENT DOCUMENTS

| | | | | |
|---|---|---|---|---|
| 2018/0236476 | A1* | 8/2018 | Covizzi | B05B 14/43 |
| 2018/0243778 | A1* | 8/2018 | Covizzi | B05B 14/43 |

FOREIGN PATENT DOCUMENTS

| | | | |
|---|---|---|---|
| JP | H531417 | A | 2/1993 |
| JP | 200918286 | A | 1/2009 |
| JP | 201275824 | A | 4/2012 |
| WO | 0000774 | A1 | 1/2000 |
| WO | 2013021817 | A1 | 2/2013 |

* cited by examiner

| | temperature (°C) | absolute humidity (g/kg') |
|---|---|---|
| a | 50 | 10 |
| b | 50 | 10 |
| c | 38 | 25.4 |
| d | 48.8 | 11.5 |
| e | 28.9 | 11.5 |
| f | 14.5 | 9.8 |
| g | 12.8 | 5.5 |
| h | 35.7 | 5.5 |
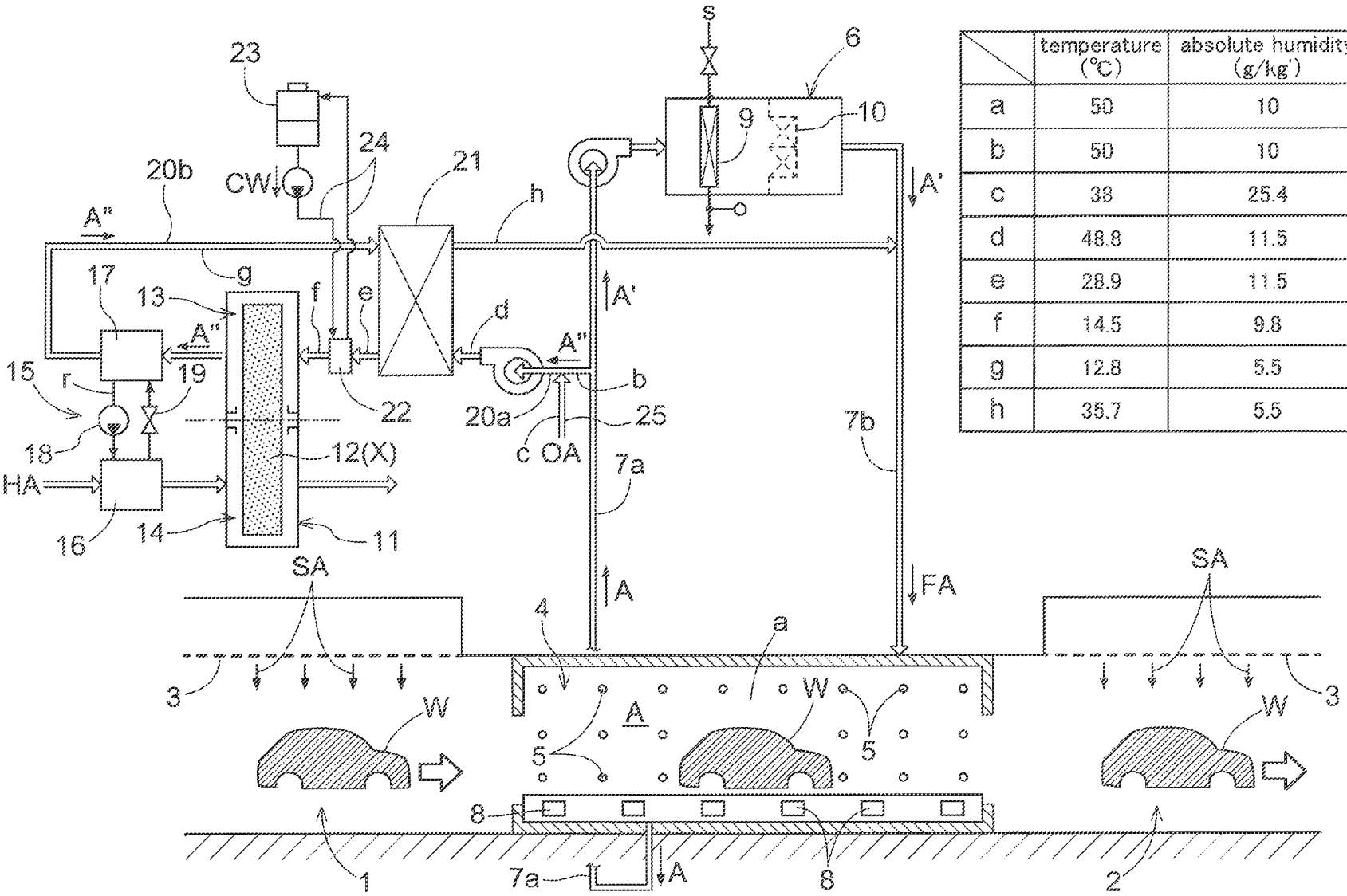

DRYING FACILITY FOR PAINTING

CROSS-REFERENCE TO RELATED APPLICATIONS

This application is the United States national phase of International Application No. PCT/JP2017/031402 filed Aug. 31, 2017, and claims priority to Japanese Patent Application No. 2016-242201 filed Dec. 14, 2016, the disclosures of which are hereby incorporated by reference in their entirety.

TECHNICAL FIELD

This invention relates to a drying facility for painting such as a flash-off facility installed in a painting booth.

More particularly, the invention relates to a drying facility for painting arranged such that by feeding air heated by a heating means and air dehumidified by a dehumidifying means to a treating chamber, evaporation of liquid content present in an undried paint coating on a painting object (a work) placed in this treating chamber is promoted

BACKGROUND ART

Conventionally, with this type of drying facility for painting, as disclosed in e.g. Patent Document 1 identified below, air withdrawn from a treating chamber (a flash-off booth 3) is heated by a heating means (an air heater 21 such as a steam coil).

And, as this heated air is fed to the treating chamber, evaporation of liquid content present in the undried paint coating of the painting object (an automobile body W) placed in the treating chamber is promoted with respect to temperature.

Further, in parallel with this evaporation promotion by heating, ambient (outside) air (OA) to be introduced to the treating chamber is cooled and dehumidified by a dehumidifying means (a first air heat exchanger 19 of an ambient air conditioning section 14).

And, as this dehumidified air is fed to the treating chamber together with the heated air described above, the evaporation of the liquid content in the undried paint coating of the painting object placed in the treating chamber is promoted with respect to humidity also.

Incidentally, it is noted that the nomenclature and reference signs in the parentheses above are those employed in Patent Document 1.

BACKGROUND ART DOCUMENT

Patent Document

Patent Document 1: Japanese Unexamined Patent Application Publication No. 2009-18286 (in particular, its FIG. 1).

SUMMARY OF THE INVENTION

Problem to be Solved by Invention

Notwithstanding the above, with the conventional facility described above and arranged such that ambient air dehumidified by the dehumidifying means is fed to the treating chamber as dehumidified air to be fed to this treating chamber, to cope with generation of water content inside the treating chamber, it is necessary to cause an amount of ambient air needed for maintaining the inside of the treating chamber under a required low humidity condition to be introduced through the dehumidifying means.

Accordingly, a greater amount of ambient air than that required for ventilation to maintain an intra-chamber concentration of e.g. a solvent or the like which is to be evaporated together with water content from the undried paint coating lower than or equal to a permissible upper limit value is to be introduced into the treating chamber.

Further, in association with this ambient air introduction, an amount of air corresponding to the amount of the introduced ambient air is to be discharged to the outside from the treating chamber. Thus, in comparison with the air discharge amount needed for the ventilation, an even greater amount of air is to be discharged to the outside from the treating chamber.

For this reason, a large amount of the high-temperature, low-humidity air (i.e. the amount of air for which production energy was needed) present in the treating chamber is discharged wastefully to the outside from the treating chamber, thus inviting a large energy loss disadvantageously.

Moreover, as the arrangement would require high-output heating means and high-output dehumidifying means in association with the above, this would result in increases in the facility cost and running cost also.

Incidentally, as a solution to the above, it is conceivable to adopt an arrangement in which, like the heating means, the air withdrawn from the treating chamber is dehumidified by the dehumidifying means and this dehumidified air is fed to the treating chamber (i.e. an arrangement of causing air circulation between the treating chamber and the dehumidifying means).

However, even if either a cooling dehumidifying technique or a adsorption dehumidifying technique is implemented in the dehumidifying means, direct dehumidification of the high-temperature and low-humidity air withdrawn from treating chamber by the dehumidifying means involves technical and economical difficulties for its realization. This fact has been the basic cause inviting the above problem.

In view of the above-described state, a principal object of the present invention is to provide a drying facility for painting which is more advantageous in terms of energy saving as well as cost with solving the above problem through adaptation of a reasonable mode of dehumidification.

Solution

A first characterizing feature of the present invention relates to a drying facility for painting. According to this feature, there is provided:

a drying facility for painting arranged such that by feeding air heated by a heating means and air dehumidified by a dehumidifying means to a treating chamber, evaporation of liquid content present in an undried paint coating on a painting object (i.e. an object to be painted) placed in this treating chamber is promoted;

wherein as the dehumidifying means, there is provided an adsorption/desorption type dehumidifying device including an air-permeable adsorption rotor carrying an adsorptive agent, the rotor having a plurality of rotor portions along a rotational direction of the rotor, each rotor portion being brought, in alternation in association with rotation of the rotor, to an adsorption area through which dehumidification-subject air (i.e. air to be dehumidified) is caused to flow and a desorption area through which desorbing air (i.e. air used for desorbing) is caused to flow;

wherein there are provided a dehumidification forward passage for guiding air withdrawn from the treating chamber as dehumidification-subject air to the adsorption area and a dehumidification return passage for guiding air past through the adsorption area to the treating chamber;

wherein a desorption heat pump is provided for heating desorbing air to be flown through the desorption area with utilizing, as a heat sink, dehumidified air which has flown through the adsorption area and sent to the dehumidification return passage; and wherein there is provided a sensible-heat heat exchanger configured to cool the dehumidification-subject air present in the dehumidification forward passage through a heat exchange reaction with dehumidified air present in the dehumidification return passage which has been cooled via absorption of its heat by the desorption heat pump.

Namely with the facility having the above-described arrangement (see FIG. 1), air withdrawn from the treating chamber 4 is fed as dehumidification-subject air A" to the adsorption area 13 of the adsorption/desorption type dehumidifying device 11 via the dehumidification forward passage 20*a*.

Then, as this dehumidification-subject air A" is caused to pass a rotor portion located at the adsorption area 13 of the air-permeable adsorption rotor 12, by the adsorptive agent X present at this rotor portion, water content contained in the dehumidification-subject air A" is adsorbed, thus dehumidifying this dehumidification-subject air A".

Also, the dehumidified air A" sent from the adsorption area 13 (namely, dehumidified air) is returned to the treating chamber 4 via the dehumidification return passage 20*b*.

With the above arrangement in combination with feeding of air A' heated by the heating means 6 (i.e. heated air) to the treating chamber 4, evaporation of liquid content present in the undried paint coating of the painting object W placed in the treating chamber 4 is effectively promoted.

Namely, with the facility having the above-described arrangement, the dehumidified air A" is produced basically through a manner of air circulation effected between the treating chamber 4 and the adsorption/desorption type dehumidifying device 11 acting as a dehumidifying means.

The dehumidified air A" sent from the adsorption area 13 has been heated by so-called heat of adsorption.

Then, with utilization of this, desorbing air HA to be flown through the desorption area 14 of the adsorption/desorption type dehumidifying device 11 is heated by the desorption heat pump 15 which uses the dehumidified air A" sent from the adsorption area 13 as its "heat sink".

Namely, taking advantage of an amount of heat contained in the dehumidified air A" which is sent under a heated state from the adsorption area 13, the arrangement causes the adsorbed water in the adsorptive agent X at the rotor portion located at the desorption area 14 (namely, the water which has been adsorbed from the dehumidification-subject air A" at the foregoing adsorption area 13) to be desorbed by the desorbing air HA.

With the above, the adsorptive agent can be regenerated to be set ready for water adsorption at the next adsorption area 13.

In this way, since the desorbing air HA is heated with utilization of the amount of heat held in the dehumidified air A" sent under a heated state from the adsorption area 13, the running cost of the adsorption/desorption type dehumidifying device 11 as the dehumidifying means can be further reduced.

In the sensible-heat heat exchanger 21, the dehumidification-subject air A" to be sent to the absorbing area 13 of the adsorption/desorption type dehumidifying device 11 via the dehumidification forward passage 20*a* (i.e. the high-temperature, low-humidity air withdrawn from the treating chamber 4) is cooled through a heat exchange reaction with the dehumidified air A" which has been cooled through heat removal by the desorption heat pump 15 (i.e. the dehumidified air to be returned to the treating chamber 4 via the dehumidification return passage 20*b*).

Namely, with the above-described cooling of the dehumidification-subject air A", while adopting the mode of operation of effecting circulation of the high-temperature and low-humidity air A in the treating chamber 4 between this treating chamber 4 and the adsorption/desorption type dehumidifying device 11, it is possible to dehumidify the high-temperature and low-humidity air A in the treating chamber 4 directly in the adsorption/desorption type dehumidifying device 11.

Further, through the heat exchange reaction in the sensible-heat heat exchanger 21, the amount of heat held in the dehumidification-subject air A" to be sent to the adsorption/desorption type dehumidifying device 11 via the dehumidification forward passage 20*a* can be collected in the dehumidified air A" to be returned to the treating chamber 4 via the dehumidification return passage 20*b*.

With this arrangement, it becomes also possible to avoid energy waste of discarding the contained heat of the high-temperature and low-humidity air A in the treating chamber 4 to the outside.

Namely, with these inventive arrangements, in comparison with the above-described conventional facility which dehumidifies ambient air to be fed to the treating chamber 4, it is possible to avoid the significant energy loss (i.e. loss of energy which has been consumed in heating and dehumidifying) which would occur otherwise due to discarding of a great amount of high-temperature and low-humidity air A in the treating chamber 4 to the outside of this treating chamber 4.

Further, as the outputs required by the heating means and the dehumidifying means can be reduced in correspondence therewith, the facility cost and its running cost too can be reduced.

Incidentally, in implementing this first characterizing feature arrangement, in the respect of feeding of the heated air A' heated by the heating means 6 and feeding of the dehumidified air A" dehumidified by the adsorption/desorption dehumidifying device 11 acting as the dehumidifying means, it is possible to adopt either a mode of arrangement in which the dehumidified air A" sent from the sensible-heat heat exchanger 21 is fed to the treating chamber 4 separately from the heated air A' heated by the heating means 6 or a mode of arrangement in which the dehumidified air A" is fed in a mixed state with the heated air A' to the treating chamber 4.

Moreover, the dehumidified air A" sent from the sensible-heat heat exchanger 21 can be further heated by the heating means 6 and then such further heated air can be fed to the treating chamber 4. Further alternatively, the dehumidified air A" sent out from the sensible-heat heat exchanger 21 can be mixed with the air withdrawn from the treating chamber 4 and the resultant mixed air can be heated by the heating means 6 and then fed to the treating chamber 4.

Or, conversely, the air withdrawn from the treating chamber 4 can be firstly heated by the heating means 6 and then fed for its dehumidification to the absorbing area 13 of the absorption/desorption dehumidifying device 11 via the dehumidification forward passage 20*a* and the sensible-heat heat exchanger 21 and the resultant dehumidified air A" can be fed to the treating chamber 4 again via the sensible-heat heat exchanger 21. Or, the heated air A' heated by the heating means 6 can be mixed with the air withdrawn from the treating chamber 4 and the resultant mixed air can be fed for its dehumidification to the adsorbing area 13 of the adsorption/desorption dehumidifying device 11 via the dehumidification forward passage 20*a* and the sensible-heat heat exchanger 21 and the resultant dehumidified air A" can be fed to the treating chamber 4 again via the sensible-heat heat exchanger 21.

A second characterizing feature of the present invention is provided to specify a preferred embodiment of the first characterizing arrangement. According to this second characterizing feature:

at a location upstream of the sensible-heat heat exchanger in the dehumidification forward passage, an ambient air introduction passage is provided for merging ambient air for treating chamber ventilation with the dehumidification-subject air in the dehumidification forward passage.

Namely, with the facility having the above arrangement (see FIG. 1), ambient air OA for treating chamber ventilation merged (combined) with the dehumidification-subject air A" in the dehumidification forward passage 20*a* via the ambient air introduction passage 25 will be firstly dehumidified, together with the dehumidification-subject air A", at the adsorption area 13 of the adsorption/desorption dehumidifying device 11 and then introduced to the treating chamber 4 via the dehumidification return passage 20*b*.

With the above, the treating chamber 4 can be ventilated with adoption of the arrangement of discharging only an amount of air A in the treating chamber 4 corresponding to the introducing amount of the ambient air OA.

Further, in this case, an amount of air required for maintaining the inside of the treating chamber 4 under the requisite low-humidity condition is secured by the amount of air A" which is circulated between the treating chamber 4 and the adsorption/desorption dehumidifying device 1. Thus, the introducing amount of the ambient air OA can be limited advantageously to the amount of air needed for e.g. ventilation of the treating chamber 4 in order to maintain the intra-chamber concentration of a solvent in the treating chamber 4 less than or equal to a permissible upper limit value.

A third characterizing feature of the present invention is provided to specify a preferred embodiment of the first or second characterizing arrangement. According to this third characterizing feature:

an aft-stage cooler is provided for cooling the dehumidification-subject air in the dehumidification forward passage cooled by the sensible-heat heat exchanger through a heat exchange reaction with cooling water fed from a cooling tower or ambient air.

Namely, with the facility having the above arrangement (see FIG. 1), as the dehumidification-subject air A" which has been cooled through the heat exchange reaction with the dehumidified air A" in the sensible-heat heat exchanger 21 is further cooled by the aft-stage cooler 22, the efficiency of water adsorption by the adsorptive agent X can be enhanced.

Thus, the dehumidification ability of the adsorption/desorption dehumidifying device 11 can be increased and this adsorption/desorption dehumidifying device 11 can be made even more compact correspondingly.

Incidentally, the aft-stage cooler 22 can be either a water-cooling type cooler configured to cool the dehumidification-subject air A" through a heat exchange reaction with cooling water CW fed from the cooling tower 23 or an air-cooling type cooler configured to cool the air A" through a heat reaction with ambient air.

Further, as an alternative arrangement, the aft-stage cooler 22 can be configured to cool the dehumidification-subject air A" through a heat exchange reaction with cold cooling medium held in a refrigerator or configured to cool the dehumidification-subject air A" through a heat exchange reaction with cooling water or brine cooled by a refrigerator.

A fourth characterizing feature of the present invention is provided to specify a preferred embodiment of any one of the first through third characterizing arrangements. According to this fourth characterizing feature:

there are provided a heating forward passage for guiding the air withdrawn from the treating chamber to the heating means and a heating return passage for guiding the heated air heated by the heating means to the treating chamber;

the dehumidification forward passage is branched from the heating forward passage to be connected to the adsorption area; and the dehumidification return passage is extended from the adsorption area to be connected to the heating return passage.

Namely, with the facility having the above arrangement (see FIG. 1), a portion of the air A withdrawn from the treating chamber 4 into the heating forward passage 7*a* is guided for its dehumidification as the dehumidification-subject air A" to the adsorption area 13 of the adsorption/desorption dehumidifying device 11 via the dehumidification forward passage 20*a*.

On the other hand, the remaining portion of the air A withdrawn from the treating chamber 4 into the heating forward passage 7*a* is guided for its heating as the heating-subject air A' (i.e. air to be heated) to the heating means 6.

And, the dehumidified air A" sent from the adsorption area 13 of the adsorption/desorption dehumidifying device 11 into the dehumidification return passage 20*b* is merged with the heated air A' guided from the heating means 6 via the heating return passage 7*b* and the resultant mixed air FA of the heated air A' and the dehumidified air A" is fed to the treating chamber 4 via the heating return passage 7*b*.

Namely, with the facility having the above arrangement, the heated air A and the dehumidified air A" can be mixed uniformly and then fed as such to the treating chamber 4.

Therefore, in comparison with an arrangement of feeding the heated air A' and the dehumidified air A" separately to the treating chamber 4, the liquid content present in the undried paint coating can be evaporated uniformly from this undried paint coating of the painting object W placed in the treating chamber 4. Consequently, the painting finish quality of the painting object W can be improved.

BRIEF DESCRIPTION OF THE DRAWINGS

FIG. 1 is a view showing a flash-off facility of a painting booth.

DESCRIPTION OF THE INVENTION

Embodiments

FIG. 1 shows a portion of a painting booth for conducting spray painting operations one after another on painting objects W (i.e. objects to be painted, which are automobile bodies in this embodiment) which are conveyed by a predetermined cycle time. And, in this FIG. 1, numeral 1 denotes a fore-stage booth for effecting a top-coating painting operation on the painting object W and numeral 2 denotes an aft-stage booth for effecting a clear coating operation on the painting object W.

In each of these fore-stage and aft-stage booths 1 and 2, clean conditioned air SA whose temperature and humidity have been conditioned appropriately is discharged downwards via a ceiling filter 3 from the entire surface of a ceiling portion of each booth. With this, over-sprayed paint produced inside the booth in association with spray painting and present in a floating state therein can be discharged speedily from the inside of this booth through a grid floor provided in each booth.

Between the fore-stage booth 1 and the aft-stage booth 2, a flash-off treating chamber 4 is provided.

A painting object W on which a top coating operation has been done in the fore-stage booth 1 is placed and held still inside this treating chamber 4 for a predetermined period, prior to a clear painting operation in the aft-stage booth 2.

In lateral wall portions and a ceiling wall portions of the treating chamber 4, a large number of air vents 5 directed to the inside of the treating chamber 4 are provided in distribution over the entire chamber inside. Namely, in the treating chamber 4, the inside of this chamber 4 is kept under certain temperature and humidity conditions (e.g. temperature of 50° C. and absolute humidity of 10 g/kg') suitable for evaporation of water content or solvent by discharging high-temperature and low-humidity treating air (air used for treating) FA via these many air vents 5, whereby evaporation of liquid content present in a undried painting coating of the painting object placed in the chamber is promoted.

And, with this evaporation promotion, a flash-off treatment is effected in which a solid component of the undried paint coating formed on the painting object W by the top coating operation effected immediately previously is increased to a predetermined value in preparation for the subsequent clear painting operation.

On the outside of the treating chamber 4, an air heating device 6 is installed as a "heating means" for heating air A' to be fed into the treating chamber 4. The many air vents 5 provided in the treating chamber 4 are communicated to an air vent of the air heating device 6 via a heating return passage 7*b*.

In the vicinity of the floor of the treating chamber 4, there are provided a large number of air inlets 8 in distribution over the entire length of the treating chamber 4. These air inlets 8 are communicated to an air inlet of the air heating device 6 via a heating forward passage 7*a*.

The air heating device 6 incorporates a heating heat exchanger 9 operable to flow high-temperature steam (s) (water vapor) as a heat medium inside heat conducting pipes. In operation, the heating-subject air A' (i.e. air to be heated) introduced to the air heating device 6 via the heating forward passage 7*a* is heated through a heat exchange reaction with the high-temperature steam (s). Then, the resultant heated air A' will be sent into the heating return passage 7*b* via the air vent of the air heating device 6.

Incidentally, the air heating device 6 is not limited to the above-described device configured to effect heating through heat exchange reaction of the heating-subject air A' with the high-temperature steam (s). The device can adopt various kinds of heating techniques such as heating the heating-subject air A' by a burner or an electric heater, etc.

On the downstream side of the heating heat exchanger 9 in the air heating device 6, a filter 10 is mounted. The air A' heated by the heating heat exchanger 9 will be caused to pass this filter 10 for dust elimination therefrom and then sent into the heating return passage 7*b*.

Further, on the outside of the treating chamber 4, there is installed an adsorption/desorption type dehumidifying device 11 as a "dehumidifying means" for dehumidifying the air A" to be fed to the treating chamber 4.

This adsorption/desorption dehumidifying device 11 includes an air-permeable adsorption rotor 12 carrying an adsorptive agent X. In the rotational range of the adsorption rotor of this adsorption/desorption dehumidifying device 11, there are formed adsorption areas 13 through which dehumidification-subject air A" is caused to flow and desorption areas 14 through which desorbing air HA is caused to flow, with the areas 13, 14 dividing the rotational range into a plurality of sections.

More particularly, in operation of this adsorption/desorption dehumidifying device 11, the plurality of rotor portions in the rotational direction of the adsorption rotor 12 will be brought one after another into, in alternation in association with rotation of the rotor, to an adsorption area 13 and a desorption area 14.

And, at the adsorption area 13, as the dehumidification-subject air A" is caused to pass the rotor portion located within this area, water content in the dehumidification-subject air A" is caused to be adsorbed to the adsorptive agent X present at this rotor portion. Namely, with this water content adsorption, the dehumidification-subject air A" is dehumidified.

Further, in parallel with the above, at the desorption area 14, as the high-temperature desorbing air HA is caused to pass the rotor portion located within this area, the water content adsorbed previously by the adsorptive agent X present at this rotor portion is caused to be desorbed to the desorbing air HA. Namely, with this water content desorption, the adsorptive agent X present at this rotor portion is "regenerated" to become ready for water adsorption in the next adsorption area 13.

This adsorption/desorption dehumidifying device 11 includes a desorption heat pump 15. This desorption heat pump 15 is configured to heat the desorbing air HA to be flown through the desorption area 14 with utilizing, as a "heat sink", the dehumidified air A" sent out from the the adsorption area 13.

More particularly, at the air inlet of the desorption area 14, there is provided a desorption-side heat exchanger 16 for effecting a heat exchange reaction of the desorbing air HA to be flown through the desorption area 14 with a cooling medium (r). At the air outlet of the adsorption area 13, there is provided an adsorption-side heat exchanger 17 for effecting a heat exchange reaction of the the dehumidified air A" past the adsorption area 13 with the cooling medium (r).

And, with this desorption heat pump 15 in operation, the cooling medium (r) discharged form a compressor 18 is caused to circulate in the desorption-side heat exchanger 16—an expansion valve 19—the adsorption-side heat exchanger 17—the compressor 18, in this order, thus, the adsorption-side heat exchanger 17 is caused to function as a "cooling medium evaporator". That is, heat is absorbed from the dehumidified air A" through removal of evaporation heat associated with evaporation of the cooling medium (r) in the adsorption-side heat exchanger 17.

Further, in parallel with the heat removal above, the desorption-side heat exchanger 17 is caused to function as a "cooling medium condenser". Namely, the desorbing air HA is heated by generation of condensation heat associated with condensation of the cooling medium (r) in the desorption-side heat exchanger 16.

Namely, the dehumidified air A" flown through the adsorption area 13 will be discharged from the adsorption area 13 under a heated state heated by the generation of so-called adsorption heat. For this, by providing the desorption heat pump 15 described above, the desorbing air HA to be fed to the desorption area 14 is heated with utilization of the amount of heat contained in the heated dehumidified air A" (in other words, the adsorptive agent X is regenerated through utilization of amount of heat contained in the dehumidified air A"). With this arrangement, the running cost of the adsorption/desorption dehumidifying device 11 is reduced.

Incidentally, in this case, as the desorption heat pump 15, there is employed a supercritical steam compression type heat pump utilizing carbon dioxide as the cooling medium (r). With this, there is secured a large temperature elevation range in the heating of the desorbing air HA in the desorption-side heat exchanger 16.

However, the desorption heat pump 15 is not limited to such supercritical steam compression type heat pump utilizing carbon dioxide as the cooling medium, but can be any of various types of heat pump.

The dehumidification forward passage 20*a* which guides the dehumidification-subject air A" to the adsorption area 13 of the adsorption/desorption type dehumidifying device 11 is branched from the heating forward passage 7*a* which guides the air taken in via the plurality of air inlets 8 and present inside the treating chamber 4 to the air heating device 6.

More particularly, a portion of the air A taken in via the plurality of air inlets 8 is guided for its dehumidification as the dehumidification-subject air A" to the adsorption area 13 of the adsorption/desorption dehumidifying device 11 via the dehumidification forward passage 20*a*. On the other hand, the remaining portion of the air A in the treating chamber 4 taken in via the plurality of air inlets 8 is guided for its heating as the heating-subject air A' to the heating means 6.

Further, the dehumidification return passage 20*b* which guides the dehumidified air A" sent out via the adsorption-side heat exchanger 17 from the adsorption area 13 of the adsorption/desorption dehumidifying device 11 is connected to the heating return passage 7*b* which guides the air A' heated by the air heating device 6 to the many air vents 5 of the treating chamber 4.

More particularly, the dehumidified air A" sent out via the adsorption-side heat exchanger 17 from the adsorption area 13 of the adsorption/desorption dehumidifying device 11 and the air A' heated by the air heating device 6 are merged and mixed together in the heating return passage 7*b*. And, this mixed air (A'+A") is fed via the many air vents 5 into the treating chamber 4 as the high-temperature and low-humidity air FA for use in the flash-off treatment.

In the dehumidification forward passage 20*a* and the dehumidification return passage 20*b*, there is incorporated a sensible-heat heat exchanger 21 which extends between these two passages 20*a*, 20*b*. By this sensible-heat heat exchanger 21, a heat exchange reaction is effected between the dehumidification-subject air A" flowing through the dehumidification forward passage 20*a* and the dehumidified air A" flowing through the dehumidification return passage 20*b*.

More particularly, a heat exchange reaction is effected in this sensible-heat heat exchanger 21 between the dehumidified air A" which has been cooled in the adsorption-side heat exchanger 17 by the heat removal by the desorption heat pump 15 and the dehumidification-subject air A" to be sent to the adsorption area 13 of the adsorption/desorption type dehumidifying device 11. That is, through this heat exchange reaction, an amount of heat contained in the dehumidification-subject air A" taken from the treating chamber 4 and under the high-temperature and low-humidity state is collected in the dehumidified air A" to be fed to the treating chamber 4.

Moreover, with the above-described heat collection, the dehumidification-subject air A" taken from the treating chamber 4 and under the high-temperature and low-humidity state is cooled to a temperature which allows dehumidification by water adsorption at the absorption area 13 of the adsorption/desorption type dehumidifying device 11.

In the dehumidification forward passage 20*a* and on the downstream side of the sensible-heat heat exchanger 21, an aft-stage cooler 22 is incorporated. And, this aft-stage cooler 22 is fed, via a cooling water circulation passage 24, with cooling water CW from which heat has been discharged into the ambient air OA in the cooling tower 23.

More particularly, the dehumidification-subject air A" which has been cooled by the heat collection in the sensible-heat heat exchanger 21 is further cooled in this aft-stage cooler 22 through a heat exchange reaction with the cooling water CW fed from the cooling tower 23. With this, the efficiency of dehumidification by the water adsorption in the adsorption area 13 is enhanced.

Further, in the dehumidification forward passage 20*a* and on the upstream side of the sensible-heat heat exchanger 21, there is connected an ambient air introduction passage 25 which introduces ambient air OA for treating chamber ventilation into the dehumidification-subject air A" to be sent to the sensible-heat heat exchanger 21.

Namely, the ambient air OA introduced into the dehumidification forward passage 20*a* via this ambient air introduction passage 25 as being mixed with the dehumidification-subject air A", is dehumidified by the adsorption/desorption type dehumidifying device 11. And, this ambient air OA is fed as a portion of the dehumidified air A" to the treating chamber 4. With this, the treating chamber 4 is ventilated.

The amount of the ambient air OA introduced from the ambient air introduction passage 25 is limited to such an air amount capable of maintaining the concentration inside the treating chamber 4 of e.g. a solvent or the like which evaporates from the undried paint coating together with water, by means of a ventilation arrangement in which in parallel with introduction of a certain amount of ambient air, an amount of air from the air A present inside the treating chamber 4 corresponding to the amount of ambient air introduction is discharged to the outside of the chamber.

In summary, with this flash-off facility, an amount of heat contained in the high-temperature and low-humidity dehumidification-subject air A" taken out of the treating chamber 4 is collected by the sensible-heat heat exchanger 21 in the dehumidified air A" to be fed to the treating chamber 4. And, as the dehumidification-subject air A" is cooled by this heat collection, this dehumidification-subject air A" can be dehumidified directly by the adsorption/desorption dehumidifying device 11. This allows dehumidification treatment in the form of air circulation between the treating chamber 4 and the adsorption/desorption dehumidifying device 11.

And, with the above, it is possible to avoid energy loss in the respect of humidity which would occur otherwise due to discarding of a large amount of high-temperature and low-humidity air A in the treating chamber 4 to the outside and also to form the adsorption/desorption type dehumidifying device 11 as a dehumidifying means efficient and compact.

Further, thanks to the heat collection in the sensible-heat heat exchanger 21, energy loss in the respect of temperature can be avoided also. So, the air heating device 6 as a heating means can also be formed efficient and compact.

Incidentally, FIG. 1 is accompanied by a table which shows one example of air temperatures (° C.) and absolute humidity (g/kg') at respective positions represented by signs (a) through (h).

Other Embodiments

Next, other embodiments of the present invention will be described respectively.

In the foregoing embodiment, there was shown an example in which the dehumidification-subject water A" is cooled in the aft-stage cooler 22 through a heat exchange reaction with the cooling water CW fed from the cooling tower 23. However, instead of this, the aft-stage cooler 23 can be configured to cool the dehumidification-subject air A" through a heat exchange reaction with ambient air via a heat conductive wall.

Further, in case river water, well water or waste water having an appropriate temperature or the like is available, the aft-stage cooler 22 can be configured to cool the dehumidification-subject air A" through a heat exchange reaction with such river water, well water or waste water having an appropriate temperature.

In case it is possible for the fore-stage sensible-heat heat exchanger 21 alone to cool the dehumidification-subject air A" to the required temperature, the aft-stage cooler 22 can be omitted.

Conversely, a plurality aft-stage coolers 22 using different cooling media may be provided for cooling the dehumidification-subject air A" in a stepwise manner.

If there is no particular necessity of forcible ventilation of the inside of the treating chamber 4, the ambient air introduction passage 25 for introducing the ambient air OA into the dehumidification forward passage 20*a* may be omitted.

The specific air passage arrangement and air venting arrangement for feeding the dehumidified air A" heated by the heat collection in the sensible-heat heat exchanger 21 and the air A' heated by the air heating device 6 as a heating means respectively to the treating chamber 4 are not limited those shown in the foregoing embodiment, but various modifications thereof are possible.

In the foregoing embodiment, with respect of the feeding of the dehumidified air A" sent from the sensible-heat heat exchanger 21 and the air A' heated by the air heating device 6 to the treating chamber 4, there was shown the arrangement in which the dehumidified air A" sent from the sensible-heat heat exchanger 21 is mixed with the air A' heated by the air heating device 6 and then fed to the treating chamber 4. Instead of this arrangement, the dehumidified air A" sent from the sensible-heat heat exchanger 21 and the air A' heated by the air heating device 6 may be fed separately to the treating chamber 4.

Further alternatively, it is also possible to adopt an arrangement in which the dehumidified air A" sent from the sensible-heat heat exchanger 21 is heated by the heating means and then the resultant heated air is fed to the treating chamber 4.

Or, it is also possible to adopt an arrangement in which the dehumidified air A" sent from the sensible-heat heat exchanger 21 is mixed with the air A withdrawn from the treating chamber 4 and the resultant mixed air is heated by the heating means and then the resultant heated air is fed to the treating chamber 4.

Further, depending on a case, it is also possible to adopt an arrangement in which either the air heated by the heating means or the mixture air of such air heated by the heating means and the air taken out of the treating chamber 4 is firstly cooled in the sensible-heat heat exchanger 21 and then dehumidified by the adsorption/desorption dehumidifying device 11 and the resultant dehumidified air is fed to the treating chamber 4 after cooling in the adsorption-side heat exchange 17 and heating in the sensible-heat heat exchanger 21.

In the foregoing embodiment, there was shown the arrangement in which liquid content present in an undried paint coating on a painting object W painted in the fore-stage booth 1 is evaporated in the treating chamber 4 prior to painting in the aft-stage booth 2. However, the arrangement is not limited thereto. The treating chamber can be any chamber inner space for treating an undried paint coating on a painting object W which is at any stage of painting. Also, it may be a chamber inner space provided separately from a painting booth.

The present invention is not limited to drying of a paint coating, but applicable to a drying treatment of any kind of substance in a variety of fields which substance requires promotion of its liquid content evaporation.

INDUSTRIAL APPLICABILITY

The present invention can be applied particularly preferably to a drying treatment of a painting object.

The invention claimed is:

1. A drying facility for promoting the evaporation of liquid content present in an undried paint coating on a painting object in a treating chamber, the drying facility comprising:

the treating chamber;

a heating device that feeds heated air to the treating chamber;

a sensible-heat heat exchanger;

a dehumidifying device;

a dehumidification forward passage configured to guide dehumidification-subject air from the treating chamber to an adsorption area of the dehumidifying device; and a dehumidification return passage configured to guide dehumidified air from the dehumidifying device to the treating chamber, wherein the dehumidification-subject air is air that is to be dehumidified by the dehumidifying device, wherein the dehumidified air is air that has been dehumidified by the dehumidifying device, wherein the dehumidifying device is an adsorption/desorption dehumidifying device comprising an air-permeable adsorption rotor carrying an adsorptive agent, the rotor having a plurality of rotor portions along a rotational direction of the rotor, each of the plurality of rotor portions being brought, in alternation in association with rotation of the rotor, to the adsorption area through which the dehumidification-subject air is caused to flow and a desorption area through which desorbing air is caused to flow, wherein a desorption heat pump heats desorbing air to be flown through the desorption area utilizing the dehumidified air as a heat sink, the dehumidified air having flown through the adsorption area and sent to the dehumidification return passage, and wherein the sensible-heat heat exchanger is configured to cool the dehumidification-subject air present in the dehumidification forward passage through a heat exchange reaction with dehumidified air present in the dehumidification return passage, the dehumidified air having been cooled via absorption of its heat by the desorption heat pump, thereby causing heat held in the dehumidification-subject air to be recovered by the dehumidified air returning to the treating chamber.

2. The drying facility of claim 1, wherein at a location upstream of the sensible-heat heat exchanger in the dehumidification forward passage, an ambient air introduction passage is provided for merging ambient air for treating chamber ventilation with the dehumidification-subject air in the dehumidification forward passage.

3. The drying facility of claim 1, wherein an aft-stage cooler is provided for cooling the dehumidification-subject air in the dehumidification forward passage cooled by the sensible-heat heat exchanger through a heat exchange reaction with cooling water fed from a cooling tower or ambient air.

4. The drying facility of claim 1, wherein:

there are provided a heating forward passage for guiding the air withdrawn from the treating chamber to the heating device and a heating return passage for guiding the heated air heated by the heating device to the treating chamber, the dehumidification forward passage is branched from the heating forward passage to be connected to the adsorption area, and the dehumidification return passage is extended from the adsorption area to be connected to the heating return passage.

5. The drying facility for painting of claim 2, wherein an aft-stage cooler is provided for cooling the dehumidification-subject air in the dehumidification forward passage cooled by the sensible-heat heat exchanger through a heat exchange reaction with cooling water fed from a cooling tower or ambient air.

6. The drying facility for painting of claim 2, wherein:

there are provided a heating forward passage for guiding the air withdrawn from the treating chamber to the heating device and a heating return passage for guiding the heated air heated by the heating device to the treating chamber, the dehumidification forward passage is branched from the heating forward passage to be connected to the adsorption area, and the dehumidification return passage is extended from the adsorption area to be connected to the heating return passage.

7. The drying facility for painting of claim 3, wherein:

there are provided a heating forward passage for guiding the air withdrawn from the treating chamber to the heating device and a heating return passage for guiding the heated air heated by the heating device to the treating chamber, the dehumidification forward passage is branched from the heating forward passage to be connected to the adsorption area, and the dehumidification return passage is extended from the adsorption area to be connected to the heating return passage.

* * * * *